US005614300A

United States Patent [19]

Cicali et al.

[11] Patent Number: 5,614,300

[45] Date of Patent: Mar. 25, 1997

[54] PORTABLE EXERCISER

[76] Inventors: Barbara G. Cicali, 4014 Cedar La., Drexel Hill, Pa. 19026; Kamran Khan, 1026 Lancaster Ave., Bryn Mawr, Pa. 19010

[21] Appl. No.: 549,505

[22] Filed: Oct. 18, 1995

[51] Int. Cl.[6] ..... B32B 9/00

[52] U.S. Cl. ..... 482/122; 428/194; 428/197; 428/193; 482/124; 482/907

[58] Field of Search ..... 428/192, 193, 428/194, 197, 225, 227, 231; 272/82, 142, 137, 143, 134, 138, 67, 135, 903, 96; 482/124, 139, 10, 38, 121, 907, 43

[56] References Cited

U.S. PATENT DOCUMENTS 3,718,329 2/1973 Sabo ..... 272/82
3,951,404 4/1976 Brown ..... 272/142
4,090,706 5/1978 Reda ..... 272/137
4,371,162 2/1983 Hartzell ..... 272/134

*Primary Examiner*—Patrick Ryan
*Assistant Examiner*—Abraham Bahta
*Attorney, Agent, or Firm*—Austin R. Miller

[57] ABSTRACT

A Portable exerciser for stretching or toning muscles of a user is provided. The exerciser has a stretchable elastic anchor loop and a plurality of supplemental elastic loops of different but interchangeable strength and lengths. Accordingly, loops can be interchanged and interconnected in a series by the use of releasable fastening means such as a buckle or the like, for interchangeably combining such loops into a variety of portable exercise devises.

6 Claims, 1 Drawing Sheet

PORTABLE EXERCISER

BACKGROUND AND SUMMARY OF INVENTION

This portable elastic band exercise devise covers all the basic exercise principals and overcomes several other previous difficulties attributed to any similar devices on the market. This device was invented so as to facilitate the exerciser in many ways.

This device is constructed of various sizes and lengths of elastic material, which when pulled, provide stretch and resistance to the muscle being exercised. Our device provides three (3) different stretch tensions for the beginner, older person or child, to the intermediary or female, to the advanced or male exerciser. These tensions allow anyone to progress or simply stabilize their muscle strength.

Here is the way this invention's interchangeable parts can be assembled in order to facilitate each individual's needs. Choose the proper strength smaller loop or loops, and choose the appropriate larger buckle loop and attach by unbuckling said larger loop and simply placing one or two of the smaller loops you have chosen within the ring. Then buckle together the larger loop, while keeping the smaller loop or loops within the circle. For example, let us assume you are somewhat of a beginner, so you would use the lighter tension buckle loop and perhaps the medium tension smaller loop. Always remember, the lighter tension loops pull first, thereby allowing you to choose where you wish the most or least resistance. If you have a shorter arm span, you may wish the greater tension to be the center buckle loop so as when you expand the device to your arm or leg expanse, you would receive greater tension. If one of your arms is the stronger, you may wish to place a stronger tension small loop on one side and a lighter tension small loop on the opposite side. You may want an entire device with maximum tension for your legs as they are the larger stronger appendages. The exchanges are innumerable and will fit any and all exercise needs.

This has also been developed for hospital use as it is imperative for all human beings to keep muscles from atrophy, especially in sedentary or older persons. Such a device is a much needed item for any and all patients, because of its versatility in strengths, lengths, and portability of size and weight. From a small child to a senior citizen, one or more strengths and lengths will accommodate them all.

This device also provides size and weight compatible to placing into one's pocket briefcase or handbag.

This facilitates the user in several ways:

- A specific time or place of exercise does not deter the device's use as it is small enough and light enough to be placed in any pocket, handbag, or briefcase.
- The periods of time can be spaced throughout the day or night, as it is always handy to the person.
- The device travels with the owner and, therefore, any trip, no matter how lengthy, never interrupts a steady exercise pattern. In other words, the importance of continuity may easily be preserved.
- This device also provides a soft underbelly for a more comfortable compatibility to the user's hands, arms, feet, and legs.
- This device also provides many lengths from which the user may choose.
- This also extends the scope of usage, since different sized people and different exercises require varied lengths, not only for dimensional reasons, but shorter lengths provide more resistance, thereby offering the more difficult versions of many exercises.

In summary, the elastic band exercise device provides innumerable combinations of interchangeable lengths and strengths which facilitate all ages and exercise abilities. It possesses a soft fabric underbelly for ease in performance and fits in any pocket, purse, or small aperture for ease of recovery and exercising continuity.

DESCRIPTION OF EXERCISING DEVICE

This device consists of three (3) strengths of 1¼ inch elastic material.

1. The lighter strength is suited for the beginner, child, or older person.

2. The medium strength is suited for the intermediary or female person.

3. The stronger elastic is suited for the advanced or male person.

Each smaller circular sewn band is approximately 20¼ inches in circumference in its finished state. The larger higher tensioned buckle band measures approximately 35 inches in circumference and the smaller tensioned buckle band measures approximately 32 inches in circumference and both are attached on both ends to a 1¼ inch wide, by 2¾ inch long, by ½ inch deep seat belt type fastener. These bands are attached by pulling the elastic through the open end apertures and sewing them securely. The bands are interchangeable. The buckle or similar type fastener may be of any type material of a sturdy nature that is either static or adjustable. If adjustable, it will allow the user to adjust the circumference to their needs. This device provides resistance to your muscles and stretches them to whatever pressure you apply. To use this device, one simply grabs the end loop or loops and pulls or stretches to the expanse they wish or are able. It is used by both arms, hands, legs, or feet to exercise every muscle of the body. It operates on the exact same principal of resistance as the large expensive machines or devices, only is small enough to place into any pocket, purse, or briefcase. The user may utilize all of the adjustment loops or simply use one loop. This device is excellent for relieving the office related injuries of back, neck, hands, etc as it offers the stretching motion to cramped portions of the body. The physical therapy industry is an excellent candidate for this device as the user can then resume the exact same exercise at home in an easy portable method, when he is ready, as this device works for every part of the body. In summary, this device supplies a complete body workout which can be accomplished in increments throughout the day because of its portability and because it supplies the numerous tensions, which dramatically cut down the time required to achieve the desired results. No more long tedious workouts which must be accomplished at a prescribed place or time.

While a preferred embodiment of the adjustable elastic band exercise device and the manner of constructing said device have been described and illustrated, it should be apparent that modifications may be made without departing from the spirit and scope of the invention.

BRIEF DESCRIPTION OF DRAWINGS AND PREFERRED EMBODIMENT

FIG. A is the view of a preferred embodiment usage of this exercise device. It is a basic preferred assembly of elastic bands, however, any combination of the eight (8) or any number of attachable bands is up to the individual's needs. The center elastic band is approximately thirty two (32) to thirty five (35) inches in circumference when the buckle is secured and comes in two (2) tensions. However, any number of tensions may be added to our basic preferred embodiment. The width measures approximately 1¼ inches but any width is within the spirit of the device. The entire expanse of a basic preferred embodiment measures approximately thirty seven (37) to thirty eight (38) inches, however, this may also vary in the spirit and scope of this invention.

FIGS. B and C are the sewn elastic bands which fit into the center buckle band portion of FIG. A. These six (6) smaller elastic sewn bands (any number is within the interchangeable idea of this device) may be interchanged by the user into the buckle band according to their needs. These bands come in three (3) tensions—light, medium, and strong, and stretch accordingly. The width is approximately 1¼ inches but this may vary as the spirit and scope of this device does not lie with lengths, widths and exact tensions, but rather with the graduated interchangability, the portability, and the ease of usage and results.

FIG. D simply demonstrates the stretchability and idea and spirit of the usage of this interchangeable elastic exercise device.

Any and all exercises performed with the hands, arms, legs, and feet may be accomplished-using this device and in only a fraction of the time it would take to achieve equal results without the device. This device is portable and may be carried in your own attached preferred embodiment or broken down into separate pieces.

We claim:

1. A portable exerciser for stretching or toning the muscles of a user, wherein said exerciser is manipulated by a user in such a way that one muscle opposes at least one other muscle, said exerciser being adjustable in stretchability and in length for effective use by users of various sizes and various strengths, said exerciser comprising a plurality of combinable stretchable elastic loops including:

a stretchable elastic anchor loop having a relaxed length in the absence of stretch and variable stretched lengths; and a plurality of stretchable supplemental elastic loops of different lengths and degrees of stretchability, each having a relaxed length and variable stretched lengths, the stretchability of one of said supplemental loops being different from the stretchability of another one of said supplemental loops; the relaxed length of one of said supplemental loops being different from said relaxed length of said anchor loop; and releasable fastening means on at least one of the aforesaid anchor loops and supplemental loops wherein at least two of said supplemental loops are removably connectable at different locations to said anchor loop but not to each other to provide a composite series of loops having a composite length, and wherein various combinations of said anchor loop and said supplemental loops provide various composite lengths and degrees of stretchability in response to application and release of tension.

2. An exercise device to strengthen and tone muscles of a user, and which may be manipulated by a user in such a way that one muscle opposes at least one other muscle, said exercise device being adjustable in length for effective use by users of various sizes and various strengths, said device comprising:

an anchor loop formed from an elastic material and having a fastener connected to said loop for opening and closing said anchor loop, said anchor loop in closed position having a relaxed length and variable stretched lengths, plural supplemental loops formed from an elastic material, each one of said supplemental loops being closed and having a relaxed length and a variable stretched length, one of said supplemental loops having a degree of stretchability that is different from a degree of stretchability of another one of said supplemental loops, said supplemental loops and said anchor loop being linkable together from end to end.

3. The exercise device of claim 1 wherein said loops are interchangeable.

4. The exercise device of claim 1 wherein at least some of said loops are of varying strength.

5. The exercise device of claim 1 wherein at least some of said loops are of different sizes.

6. The exercise device of claim 1 wherein at least three sets of said supplemental loops are provided, each set having a different degree of stretchability.

* * * * *

UNITED STATES PATENT AND TRADEMARK OFFICE

CERTIFICATE OF CORRECTION

PATENT NO. : 5,614,300
DATED : Mar. 25, 1997
INVENTOR(S) : Cicali, et al.

It is certified that error appears in the above-identified patent and that said Letters Patent is hereby corrected as shown below:

The title page should be deleted to appear as per attached title page.

Please delete columns 1-4 and substitute columns 1-4 as per attached

Signed and Sealed this

Seventh Day of October, 1997

*Attest:*

*Attesting Officer*

Bruce Lehman

BRUCE LEHMAN

*Commissioner of Patents and Trademarks*

United States Patent [19]

Cicali et al.

[11] Patent Number: 5,614,300

[45] Date of Patent: Mar. 25, 1997

[54] PORTABLE EXERCISER

[76] Inventors: Barbara G. Cicali, 4014 Cedar La., Drexel Hill, Pa. 19026; Kamran Khan, 1026 Lancaster Ave., Bryn Mawr, Pa. 19010

[21] Appl. No.: 549,505

[22] Filed: Oct. 18, 1995

[51] Int. Cl.[6] ..... B32B 9/00

[52] U.S. Cl. ..... 482/122; 428/194; 428/197; 428/193; 482/124; 482/907

[58] Field of Search ..... 428/192, 193, 428/194, 197, 225, 227, 231; 272/82, 142, 137, 143, 134, 138, 67, 135, 903, 96; 482/124, 139, 10, 38, 121, 907, 43

[56] References Cited

U.S. PATENT DOCUMENTS

| | | | |
|---|---|---|---|
| 3,718,329 | 2/1973 | Sabo | 272/82 |
| 3,951,404 | 4/1976 | Brown | 272/142 |
| 4,090,706 | 5/1978 | Reda | 272/137 |
| 4,371,162 | 2/1983 | Hartzell | 272/134 |

*Primary Examiner*—Patrick Ryan
*Assistant Examiner*—Abraham Bahta
*Attorney, Agent, or Firm*—Austin R. Miller

[57] ABSTRACT

A kit for a portable exercise has a stretchable elastic anchor loop and a plurality of supplemental elastic loops of different but interchangeable strengths and lengths, and releasable fastening means for interchangeably combining such loops in series connection into a variety of portable exercise devices.

6 Claims, 1 Drawing Sheet

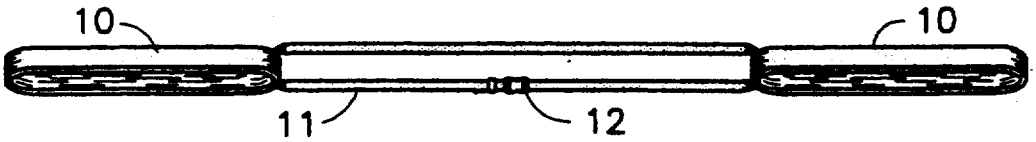

PORTABLE EXERCISER

BACKGROUND OF THE INVENTION

This invention relates to an exercise device, and more particularly to a portable elastic band exerciser capable of performing many basic exercises for exercising and toning of muscles.

FIELD OF THE INVENTION

This invention relates to devices for stretching and toning muscles to achieve health benefits.

SUMMARY OF THE INVENTION

This invention relates to an exercising device constructed of various sizes and lengths of elastic material, which when pulled, provide stretch and resistance to the muscle being exercised. It provides loops of three different stretch tensions for selection by the user. These tensions allow anyone to progress or simply stabilize muscle strength.

The invention is directed to interchangeable loops that can be assembled by buckling in order to facilitate each individual's needs. One need only choose the proper strength between smaller loops or larger loops, and choose an appropriate larger buckle loop and attach by unbuckling one loop and simply placing one or two smaller loops within the ring, and buckle the larger loop while keeping the smaller loop or loops within the larger loop.

In this way someone who is somewhat of a beginner would select a lighter tension buckle loop and perhaps a medium tension smaller loop. The lighter tension loops extend first, thereby allowing the user to choose where he or she wishes to apply the most or least resistance. Someone having a shorter arm span may wish the greater tension to be located at the center loop so that the device would receive greater tension when extended to an arm or leg. If one of the user's arms is the stronger, he or she may wish to place a stronger tension small loop on one side of the exerciser's body and a lighter tension small loop on the opposite side. The user may want an entire device with maximum tension for use by the legs as they are the larger and stronger appendages. The possible exchanges of loops are innumerable and will fit any and all exercise needs.

This invention has also been developed for hospital use as it is imperative to keep muscles from atrophy, especially in sedentary or older persons. Such a device is a much needed item for any and all patients, because of its versatility in strengths, lengths, and portability of size and weight. From a small child to a senior citizen, one or more strengths and lengths will accommodate them all.

DESCRIPTION OF PREFERRED EMBODIMENT

Figure 1:
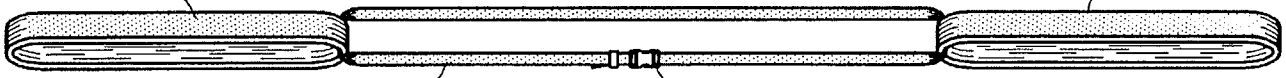
FIG. 1 is a view of a preferred embodiment involving three loops buckled together in series. It is a basic preferred assembly of elastic bands, however, use of any combination of the eight or any number of attachable bands is up to the individual's needs. For example, the center elastic band, or anchor loop, is approximately thirty-two to thirty-five inches in circumference when the buckle is secured and comes in two tensions. However, any number of tensions may be added to the basic preferred embodiment. The width measures approximately 1¼ inches but any width is within the spirit of the device. The entire expanse of a basic preferred embodiment measures approximately thirty seven to thirty eight inches, however, this may also vary in the spirit and scope of this invention.
Figure 3:
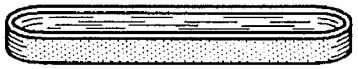
FIGS. 2 and 3 show sewn elastic bands or loops which can combine with the center buckle loop portion of FIG. 1. These six smaller elastic sewn bands (any number is within the interchangeable ideas of this device) may be interchanged from the kit by the user into the buckle band according to their needs. These bands come in three strengths — light, medium, and strong, and stretch accordingly. The width is approximately 1¼ inches but this may vary as the spirit and scope of this device does not lie with lengths, widths and exact degrees of stretchability, but rather with the graduated interchangeability, the portability, and the ease of usage and results.
Figure 4:
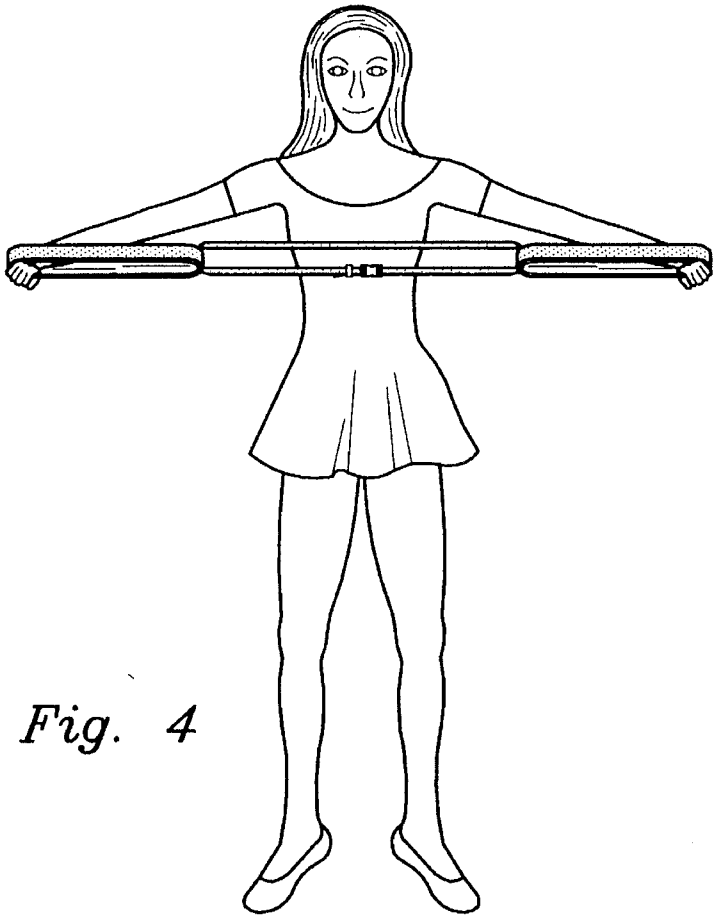
FIG. 4 shows a person exercising with a device according to this invention, and simply demonstrates the stretchability and idea and spirit of the usage of this interchangeable elastic exercise device. Any and all exercises performed with the hands, arms, legs, and feet may be accomplished using this device and in only a fraction of the time it would take to achieve equal results without the device. This device is portable and may be carried as an attached preferred embodiment or broken down into separate pieces or loops.
Figure 2:
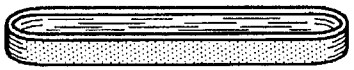

A typical kit according to this invention consists of three strengths of 1¼ inch elastic material.

1. The lighter strength loops are suited for the beginner, child or older person.

2. The medium strength loops are suited for an intermediate person.

3. The stronger elastic loops are suited for an advanced person.

Each smaller circular sewn band 10 is approximately 20¼ inches in circumference in its finished state. The larger higher tensioned buckle band 11 measures approximately 35 inches in circumference and the smaller tensioned buckle band measures approximately 32 inches in circumference and both are attached on both ends to a 1¼ inch wide, by 2¾ inch long, by ½ inch deep seat belt-type fastener. These bands are attached by pulling the elastic through the open end apertures and sewing them securely. The bands 11 are interchangeable as regards strength. The buckle 12 or similar type fastener may be of any type material of a sturdy nature that is either static or adjustable. If adjustable, it will allow the user to adjust the circumference to the needs.

This exerciser provides resistance to the muscles and stretches them to whatever degree of pull is applied. To use the exerciser one simply grabs the end loop or loops and pulls or stretches to the extent desired or achievable. It is used by any of arms, hands, legs, or feet to exercise every muscle of the body. It operates on the principle of resistance, as do the large expensive machines or devices, but is small enough to place into any pocket, purse, or briefcase. The user may utilize all of the adjustment loops or simply use one loop. This device is excellent for relieving the office-related injuries of back, neck, hands, etc as it offers the stretching motion to cramped portions of the body. The physical therapy industry is an excellent candidate for this device as the user can then resume the exact same exercise at home in an easy and portable method, when ready, as this device works for every part of the body. In summary, this device supplies a complete body workout which can be accomplished in increments throughout the day because of its portability and because it supplies the numerous degrees of strength, which dramatically cut down the time required to achieve the desired results. No more long tedious workouts are required to be accomplished at a prescribed place or time.

This device also provides small size and weight for placing into one's pocket, briefcase or handbag.

This facilitates the user in several ways:

- A specific time or place of exercise does not deter use, as it is small enough and light enough to be placed in any pocket, handbag or briefcase.

- The periods of time of use can be spaced throughout the day or night, as the exerciser is always handy to the person.

- The exerciser travels with the owner and, therefore, any trip, no matter how long, never interrupts a steady exercise pattern. In other words, the importance of continuity may easily be preserved.

- This exerciser also provides a soft underbelly for a more comfortable compatibility to the user's hands, arms, feet and legs.

- This device also provides many lengths and strengths of loops from which the user may choose.

This invention also extends the scope of usage, since different sized people and different exercises require varied loop lengths, not only for dimensional reasons. Since shorter loop lengths provide more resistance they offer the more strenuous versions of many exercises.

In summary, the elastic band exerciser of this invention provides innumerable combinations of interchangeable lengths and strengths of loops which facilitate all ages and exercise abilities. It possesses a soft fabric underbelly for ease of performance and fits in any pocket, purse or small aperture for ease of recovery and exercising continuity.

While a preferred embodiment of the adjustable elastic band exercise device and the manner of constructing said device have been described and illustrated, it should be apparent that modifications may be made without departing from the spirit and scope of the invention.

We claim:

1. A portable exerciser for stretching or toning the muscles of a user, wherein said exerciser is manipulated by a user in such a way that one muscle opposes at least one other muscle, said exerciser being adjustable in stretchability and in length for effective use by users of various sizes and various strengths, said exerciser comprising a plurality of combinable stretchable elastic loops including:

a stretchable elastic anchor loop having a relaxed length in the absence of stretch and variable stretched lengths; and a plurality of stretchable supplemental elastic loops of different lengths and degrees of stretchability, each having a relaxed length and variable stretched lengths, the stretchability of one of said supplemental loops being different from the stretchability of another one of said supplemental loops; the relaxed length of one of said supplemental loops being different from said relaxed length of said anchor loop; and releasable fastening means on at least one of the aforesaid anchor loops and supplemental loops wherein at least two of said supplemental loops are removably connectable at different locations to said anchor loop but not to each other to provide a composite series of loops having a composite length, and wherein various combinations of said anchor loop and said supplemental loops provide various composite lengths and degrees of stretchability in response to application and release of tension.

2. An exercise device to strengthen and tone muscles of a user, and which may be manipulated by a user in such a way that one muscle opposes at least one other muscle, said exercise device being adjustable in length for effective use by users of various sizes and various strengths, said device comprising:

an anchor loop formed from an elastic material and having a fastener connected to said loop for opening and closing said anchor loop, said anchor loop in closed position having a relaxed length and variable stretched lengths, plural supplemental loops formed from an elastic material, each one of said supplemental loops being closed and having a relaxed length and a variable stretched length, one of said supplemental loops having a degree of stretchability that is different from a degree of stretchability of another one of said supplemental loops, said supplemental loops and said anchor loop being linkable together from end to end.

3. The exercise device of claim 1 wherein said loops are interchangeable.

4. The exercise device of claim 1 wherein at least some of said loops are of varying strength.

5. The exercise device of claim 1 wherein at least some of said loops are of different sizes.

6. The exercise device of claim 1 wherein at least three sets of said supplemental loops are provided, each set having a different degree of stretchability.

* * * * *